US007339143B2

(12) United States Patent
Cho

(10) Patent No.: US 7,339,143 B2
(45) Date of Patent: Mar. 4, 2008

(54) EXPANDING SYSTEM USING PLASMA DISCHARGE

(75) Inventor: Yong-So Cho, Namyangju-si (KR)

(73) Assignee: Swell Tech Co., Ltd., Seoul (KR)

( * ) Notice: Subject to any disclaimer, the term of this patent is extended or adjusted under 35 U.S.C. 154(b) by 465 days.

(21) Appl. No.: 11/036,378

(22) Filed: Jan. 18, 2005

(65) Prior Publication Data

US 2006/0102039 A1 May 18, 2006

(30) Foreign Application Priority Data

Nov. 15, 2004 (KR) ..... 10-2004-0092919

(51) Int. Cl.
*H05B 6/10* (2006.01)

(52) U.S. Cl. ..... 219/628; 219/629; 219/654; 219/668

(58) Field of Classification Search ..... 219/628–636, 219/654, 659, 668, 727
See application file for complete search history.

(56) References Cited

U.S. PATENT DOCUMENTS 4,723,439 A * 2/1988 Asakura et al. ..... 73/29.05
4,995,731 A * 2/1991 Hori et al. ..... 374/43
5,353,000 A * 10/1994 Morris et al. ..... 335/216
5,600,997 A * 2/1997 Kemp et al. ..... 73/290 V
6,524,459 B1 * 2/2003 Niidome ..... 204/667
2005/0115361 A1 * 6/2005 Forbes Jones et al. ..... 75/336

* cited by examiner

*Primary Examiner*—Tuyet Vo
(74) *Attorney, Agent, or Firm*—Birch, Stewart, Kolasch & Birch, LLP

(57) ABSTRACT

The present invention relates to an expansion system using a plasma discharge in which in which a charged electric energy is fast discharged, so that a high pressure is generated within liquid based on an impact wave, which can be used in various industrial fields as a simple expanding method. The expansion system using a plasma discharge comprises a capsule for sealingly storing a certain liquid therein; a cable of which one end is connected with an expansion wire within a liquid of the capsule, and other end is connected to the outside of the capsule; and a controller that converts an external AC power inputted through a terminal into a DC power and indicates the power on a lamp and a voltage meter and applies a high voltage energy to the cable in cooperation with an operation of the push button, wherein an expansion is instantly achieved in the interior of the liquid.

2 Claims, 2 Drawing Sheets

EXPANDING SYSTEM USING PLASMA DISCHARGE

BACKGROUND OF THE INVENTION

1. Field of the Invention

The present invention relates to an expanding system using a plasma discharge, and in particular to an expanding system using a plasma discharge in which a charged electric energy is fast discharged, so that a high pressure is generated within liquid based on an impact wave, which can be used in various industrial fields as a simple expanding method.

2. Description of the Background Art

FIG. 1 is a schematic view illustrating the construction of a conventional explosion apparatus.

As shown therein, reference numeral 1 represents a power for generating explosive spark, 2 represents a capacitor for charging electric energy, 3 represents a resistor, 4 represents a switch for performing explosion, and 5 represents a capsule for receiving an expanding compound.

With the above constructions, a DC (Direct Current) power 1 is connected, and the switch 4 is turned on, and an electric charge is charged and discharged in the capacitor 2. A compound in the capsule 5 is lighted for thereby generating expanding force. The expansion energy by the compound is generally over 10 times of the energy stored in the capacitor 2.

However, in the above construction, since a large number of devices is used, it takes too much time until the expansion. Therefore, it is impossible to fully and instantly receive the input of energy for storing energy and generating plasma, so that an expansion element for generating plasma is not successful. The whole efficiency of the expansion work by plasma does not exceed about 15%.

SUMMARY OF THE INVENTION

Accordingly, it is an object of the present invention to provide an expansion system using a plasma discharge capable of overcoming the problems encountered in the conventional art.

It is another object of the present invention to provide an expansion system using a plasma discharge in which in which a charged electric energy is fast discharged, so that a high pressure is generated within liquid based on an impact wave, which can be used in various industrial fields as a simple expanding method.

To achieve the above objects, there is provided an expansion system using a plasma discharge, comprising a capsule for sealingly storing a certain liquid therein; a cable of which one end is connected with an expansion wire within a liquid of the capsule, and other end is connected to the outside of the capsule; and a controller that converts an external AC power inputted through a terminal into a DC power and indicates the power on a lamp and a voltage meter and applies a high voltage energy to the cable in cooperation with an operation of the push button, wherein an expansion is instantly achieved in the interior of the liquid.

In the present invention, an expansion wire of the cable is designed to generate an instant expansion in the interior of liquid using a conductive metallic wire.

A DC power of one side is connected with a spark gap by disposing a first capacitor C1, a push button, a transformer, and a second capacitor C2 therebetween, and a DC power of the other side is connected with the spark gap by disposing a third capacitor C3 and an expansion wire therebetween for thereby achieving an instant expansion.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
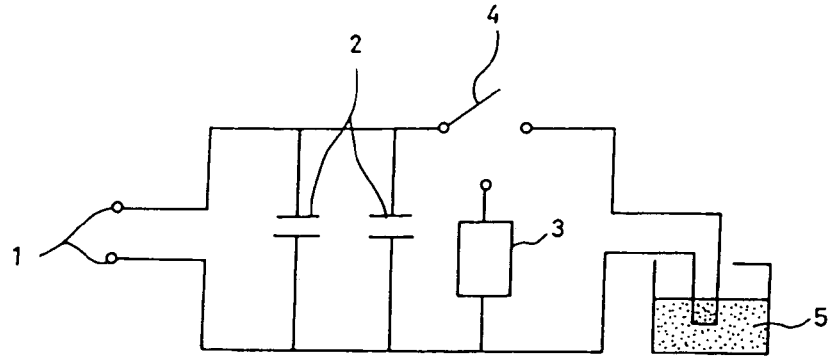
Fig.1 PRIOR ART
FIG. 1 is a schematic view illustrating the construction of a conventional explosion apparatus.
Figure 2:
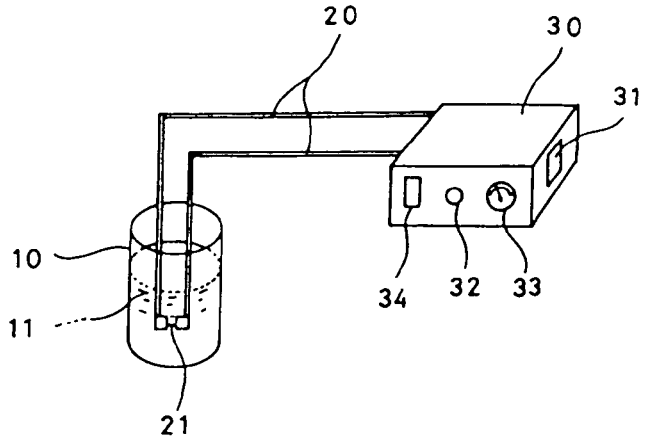
FIG. 2 is a schematic view illustrating the construction of a major part of an expanding system according to the present invention.

FIG. 2 is a schematic view illustrating the construction of a major part of an expanding system according to the present invention.

The capsule 10 according to the present invention is designed to sealingly store a certain liquid therein, for example, a non-compressive liquid, particularly, water. Since a certain liquid 11 is charged in the interior of the capsule 10, the capsule 10 may be formed of using a metallic material or a non-metallic material. The capsule 10 may have different sizes and shapes depending on the current site condition needing a certain expansion force. In the present invention, since the non-compressive liquid 11 like water is used instead of conventional compound, it is very economical and safe.

In the present invention, one end of a cable 20 is connected with an expansion wire 21 within the liquid 11 of the capsule 10. Here, the cable 20 has various types depending on the condition and distance of the expansion site and is detachably connected for easier exchange.

At this time, the expansion wire 21 of the cable 20 is formed of a conductive metallic material, for example, is a copper wire having a diameter of $50\times10^{-6}$ m, and a length of 0.01 m. At this time, the kind, diameter and length of the expansion wire 21 may be properly determined based on the expansion force needed at the work site. In addition, in the case that the expansion wire 21 is formed of copper as a conductive metallic wire, another similar conductive metallic wire may be used in consideration with the copper's melting point (Tm) of 1385K, boiling point (Tb) of 2595K, and heat capacity of 400 J/KgK. In addition, a certain metallic wire having a melting point much higher than that of the copper is used at a portion in which the expansion wire 21 is supported for thereby maintaining a certain interval for discharge.

In addition, the controller 30 according to the present invention is designed to convert an external AC inputted through a terminal 31 into a DC power and to apply a high voltage energy to the cable 20 based on the DC power. The DC power converted by the controller 30 is indicated on a lamp 32 and a voltage meter 33 for visual confirmation.

Figure 3:
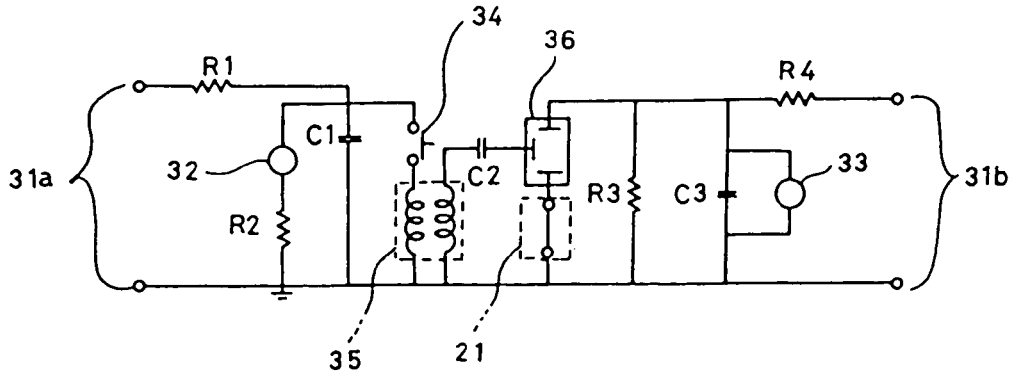
FIG. 3 is a circuit diagram of an expanding system according to the present invention.

FIG. 3 is a view illustrating the construction of the whole circuits for an operation of the expansion system according to the present invention.

As shown therein, in the controller 30, a DC power 31*a* of one side is connected with a spark gap 36 by disposing a first capacitor C1, a push button 34, a transformer 35, and a second capacitor C2 therebetween, and the DC power 31*a* of the other side is connected with a spark gap 36 by disposing a third capacitor C3 and an expansion wire 21 therebetween.

In more details, the input of the transformer 35, the first capacitor C1 and the lamp 32 are connected with the DC power 31*a* of the left side in parallel, and the push button 34 is connected with the transformer 35 in series. The output side of the transformer 35 is connected with the spark gap 36 through the second capacitor C2. Here, the spark gap 36, the third capacitor C3 and the voltage meter 33 are connected with the DC power 31*b* of the right side in parallel, and the expansion wire 21 is connected with the spark gap 36 in series.

In the test of the present invention, the DC power 31*a* and 31*b* are about 3000V, and the DC power of the right side can be changed up to 500V. The third capacitor C3 that is a main storage of the discharge energy for expansion is 1 μF and 3000V, and the first capacitor C1 and the second capacitor C2 of the assistant storage are 0.51 μF and 3000V, respectively.

The first capacitor C1 and the third capacitor C3 are charged by the DC powers 31*a* and 31*b*, respectively and it is possible to visually check the standby state on the lamp 32 and the voltage meter 33. In this state, when the push button 34 is pushed, the energy of the first capacitor C1 is applied to the ignition electrode of the spark gap 36 through the transformer 35 and the second capacitor C2 for thereby forming a pulse of 12000V thereat. At the time when the spark gap 36 gests conducted, the electric charge of the third capacitor C3 is applied to the expansion wire 21 for thereby generating discharge.

Figure 4:
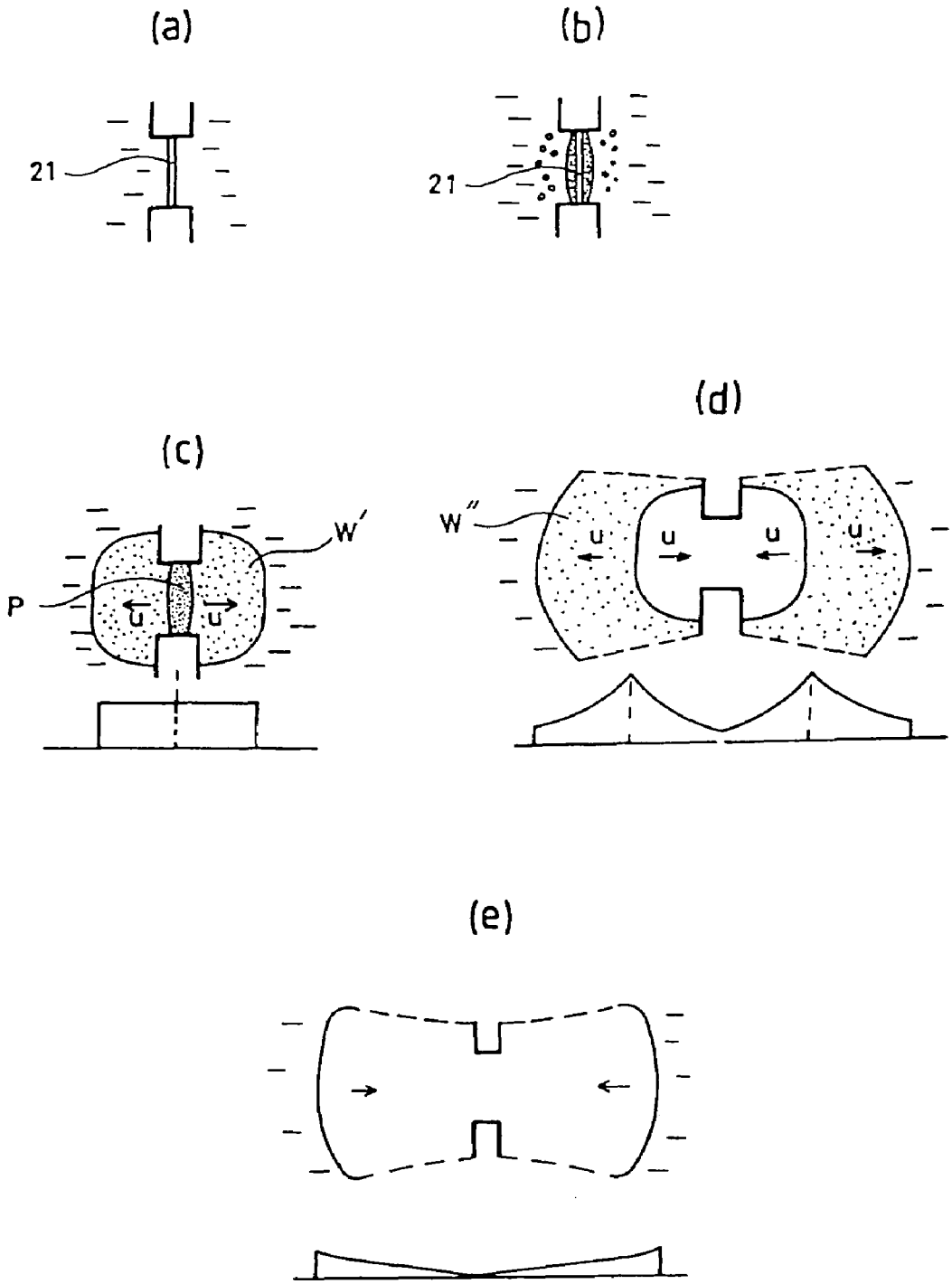
FIGS. 4A through 4E are views illustrating an expanding process together with a pressure distribution diagram according to the present invention.

FIGS. 4A and 4B are views illustrating the process of the expansion and the pressure distribution sequences.

As shown in FIG. 4A, the temperature of the expansion wire 21 is increased and reaches the melting point. As shown in FIG. 4B, the expansion wire 21 gets melted, and at the same time the discharge is generated for thereby generating an impact wave. As shown in FIG. 4C, a charge distance is formed together with the plasma channel. The electric energy is applied to the discharge plasma channel, and the impact wave W' is transferred without any decrease in the width. At this time, the pressure distribution is uniform in the impact wave W'.

As shown in FIG. 4D, the discharge is finished, and a thin wave that does not reach the front surface of the impact wave occurs at the center and gets started to spread, so that the impact wave W" is more spread. At this time, the pressure distribution is the highest at the center and gets weakened toward the surrounding portions. As shown in FIG. 4E, the thin waves are weakened, and the whole pressure distribution is decreased.

The following table 1 shows a result of the test using the apparatus according to the present invention based on a computer simulation. As seen therein, the speed E of the liquid (water) at the front surface of the impact wave μ represents the energy accumulated at the impact waves and plasma channel, and $P_{max}$ represents a pressure in the impact waves, and d represents the expansion center with respect to the front surface of the impact wave, namely, the distance from the center of the expansion wire 21. As seen in the table 1, the impact waves form a higher expansion energy and pressure at a shorter distance.

In the system according to the present invention, it is possible to achieve a small size and a good movement and a high efficiency of over 50%. Any environmental and biological problems do not occur, and the noises due to expansion are small for thereby minimizing any pollution.

TABLE 1

| μ(m/s) | E(J) | $P_{max}$ (atm) | D(mm) |
|---|---|---|---|
| 1.0 | 0.58 | 16.87 | 8.2 |
| 5.0 | 3.03 | 82.83 | 8.3 |
| 7.0 | 4.32 | 116.21 | 8.3 |
| 10.0 | 6.31 | 166.23 | 8.3 |
| 15.0 | 9.82 | 251.42 | 8.33 |
| 20.0 | 13.62 | 337.14 | 8.43 |
| 40.0 | 31.53 | 689.81 | 8.56 |
| 70.0 | 68.03 | 1247.81 | 8.90 |

As described above, in the expansion system using a plasma discharge according to the present invention, a high pressure is generated based on an impact wave by instantly discharging a charged electric energy. Therefore, the present invention may be used in various industrial fields.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An expansion system using a plasma discharge, comprising:

a capsule for sealingly storing a certain liquid therein;

a cable of which one end is connected with an expansion wire within a liquid of the capsule, and other end is connected to the outside of the capsule; and a controller that converts an external AC (Alternating Current) power inputted through a terminal into a DC (Direct Current) power and indicates the power on a lamp and a voltage meter and applies a high voltage energy to the cable in cooperation with an operation of the push button, wherein an expansion is instantly achieved in the interior of the liquid;

wherein a DC power of one side is connected with a spark gap by disposing a first capacitor C1, a push button, a transformer, and a second capacitor C2 therebetween, and a DC power of the other side is connected with the spark gap by disposing a third capacitor C3 and an expansion wire therebetween for thereby achieving an instant expansion.

2. The system of claim 1, wherein said expansion wire of the cable is designed to generate an instant expansion in the interior of liquid using a conductive metallic wire.

* * * * *